US007839395B2

(12) United States Patent
Chung et al.

(10) Patent No.: US 7,839,395 B2
(45) Date of Patent: Nov. 23, 2010

(54) FLAT DISPLAY APPARATUS AND PICTURE QUALITY CONTROLLING METHOD BASED ON PANEL DEFECTS

(75) Inventors: In Jae Chung, Gwacheon-si (KR); Chul Sang Jang, Anyang-si (KR); Young Woo Choi, Anyang-si (KR); Jong Hee Hwang, Osan-si (KR)

(73) Assignee: LG. Display Co., Ltd., Seoul (KR)

( * ) Notice: Subject to any disclaimer, the term of this patent is extended or adjusted under 35 U.S.C. 154(b) by 1182 days.

(21) Appl. No.: 11/477,228

(22) Filed: Jun. 29, 2006

(65) Prior Publication Data

US 2007/0091041 A1 Apr. 26, 2007

(30) Foreign Application Priority Data

Oct. 25, 2005 (KR) ..... 10-2005-0100927

(51) Int. Cl.
*G09G 5/00* (2006.01)

(52) U.S. Cl. ..... 345/204; 345/90; 345/690; 345/698; 348/180; 348/658; 348/246; 349/54; 349/192

(58) Field of Classification Search ..... 345/904, 345/87–100, 204, 214, 690, 698; 324/770; 326/38; 365/189.2; 348/180–194, 658, 745, 348/246–280; 349/54, 192
See application file for complete search history.

(56) References Cited

U.S. PATENT DOCUMENTS 5,504,504 A * 4/1996 Markandey et al. ..... 345/214

(Continued)

FOREIGN PATENT DOCUMENTS

CN 1479529 3/2004

(Continued)

OTHER PUBLICATIONS

Search Report dated Feb. 7, 2007 for corresponding European Patent Application No. 06 01 2124.

(Continued)

*Primary Examiner*—Amare Mengistu
*Assistant Examiner*—Koosha Sharifi
(74) *Attorney, Agent, or Firm*—Brinks Hofer Gilson & Lione

(57) ABSTRACT

A flat panel display device may improve picture quality by compensating a panel defect by use of a circuit and a picture quality controlling method.

A flat panel display device includes a display panel. A memory stores a location information and a compensation value for a panel defect location on the display panel. A first converter calculates a brightness and color difference signals from red, green, blue video signals to be displayed in the display panel. The first converter expands the number of data bits of the brightness signal to generate the expanded brightness signal. A compensating part generates a compensated brightness signal by increasing or decreasing the expanded brightness signal of the video signal to be displayed in the panel defect location. A second converter calculates the red, green, blue signals from the color difference signal and the compensated brightness signal, and generates the compensated video signal by reducing the number of bits of the calculated red, green, blue signals. A drive circuit drives the display panel by use of the compensated video signal and the uncompensated video signal.

16 Claims, 9 Drawing Sheets

U.S. PATENT DOCUMENTS

| | | | | |
|---|---|---|---|---|
| 6,618,115 | B1 * | 9/2003 | Hiroki | 349/192 |
| 6,704,008 | B2 * | 3/2004 | Naito et al. | 345/207 |
| 6,831,995 | B1 * | 12/2004 | Asano et al. | 382/141 |
| 2002/0122123 | A1 * | 9/2002 | Kimura | 348/246 |
| 2005/0116917 | A1 * | 6/2005 | Aoki | 345/99 |

FOREIGN PATENT DOCUMENTS

| | | | |
|---|---|---|---|
| EP | 1 225 557 | | 7/2002 |
| EP | 1 225 557 | A1 | 7/2002 |
| JP | 06-067620 | | 3/1994 |
| JP | 07-261719 | | 10/1995 |
| JP | 07261719 | A * | 10/1995 |
| JP | 2000-125225 | | 4/2000 |
| JP | 2002-366109 | | 12/2002 |
| JP | 2003-114639 | | 4/2003 |
| JP | 2003-316330 | | 11/2003 |
| JP | 2006-146246 | | 6/2006 |
| JP | 2007-122009 | | 5/2007 |

OTHER PUBLICATIONS

Office Action issued in corresponding Chinese Patent Application No. 2006100871686; issued Jun. 6, 2008.

Office Action issued in corresponding Japanese Patent Application No. 2006-168227; issued Aug. 17, 2009.

* cited by examiner

FLAT DISPLAY APPARATUS AND PICTURE QUALITY CONTROLLING METHOD BASED ON PANEL DEFECTS

This application claims the benefit of Korean Patent Application No. P2005-0100927 filed in Korea on Oct. 25, 2005 which is hereby incorporated by reference.

BACKGROUND

1. Technical Field

The present invention relates to a display device, and more particularly to a flat panel display device that is adaptive for improving picture quality by compensating a panel defect by use of a circuit, and a picture quality controlling method on the panel defect.

2. Description of the Related Art

Flat panel display devices may have reduced weight and size, which has been a disadvantage of a cathode ray tube. A flat panel display device includes liquid crystal display, field emission display, plasma display panel, organic light emitting diode, and other emerging technologies.

The flat panel display devices may include a display panel for displaying a picture, and a panel defect that has been found in a test process in such a display panel. Herein, a mura or a panel defect means a display spot accompanying brightness difference on a display screen. Panel defects are mostly generated in a fabricating process, and might have a fixed form such as dot, line, belt, circle, polygon, or an undetermined form in accordance with the cause of their generation. Examples of a panel defect having such various forms are shown in FIGS. 1 to 3. FIG. 1 represents a panel defect of undetermined form, FIG. 2 represents a panel defect of vertical belt shape, and FIG. 3 represents a panel defect of fixed form. The panel defect of vertical belt shape may be generated because of overlapping exposure, lens number difference, or other processing defect, and the panel defect of dot shape is manly generated by impurities. The picture displayed in the location of such a panel defect may appear to be darker or brighter than an ambient non-panel defect area. Color difference may appear when compared with the non-panel defect area.

The panel defect might be connected to the defect of products in accordance with the degree, the defect of such products drops yield, and this leads to the increase of cost. Further, even though the product where the panel defect is found is shipped as a good product, the picture quality deteriorated due to the panel defect drops the reliability of the product.

Accordingly, various methods have been proposed in order to improve the panel defect. However, improvement methods of the related art are mainly for solving problems in the fabricating process, and there is a disadvantage in that it is difficult to properly deal with the panel defect generated in the improved process. Therefore, a need exists for an improvement in image display by compensating for the panel defect.

SUMMARY

A picture quality controlling method on the panel defect includes measuring a brightness and a color difference in a panel defect location. In the panel defect location, a brightness or a color difference is different from that of at least one of a brightness or a color difference of a different part in a display panel. A compensation value related to the panel defect location is determined and a compensated video signal is generated using an input video signal and the compensation value. A display panel is then driven using the compensated video signal.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENT

Figure 1:
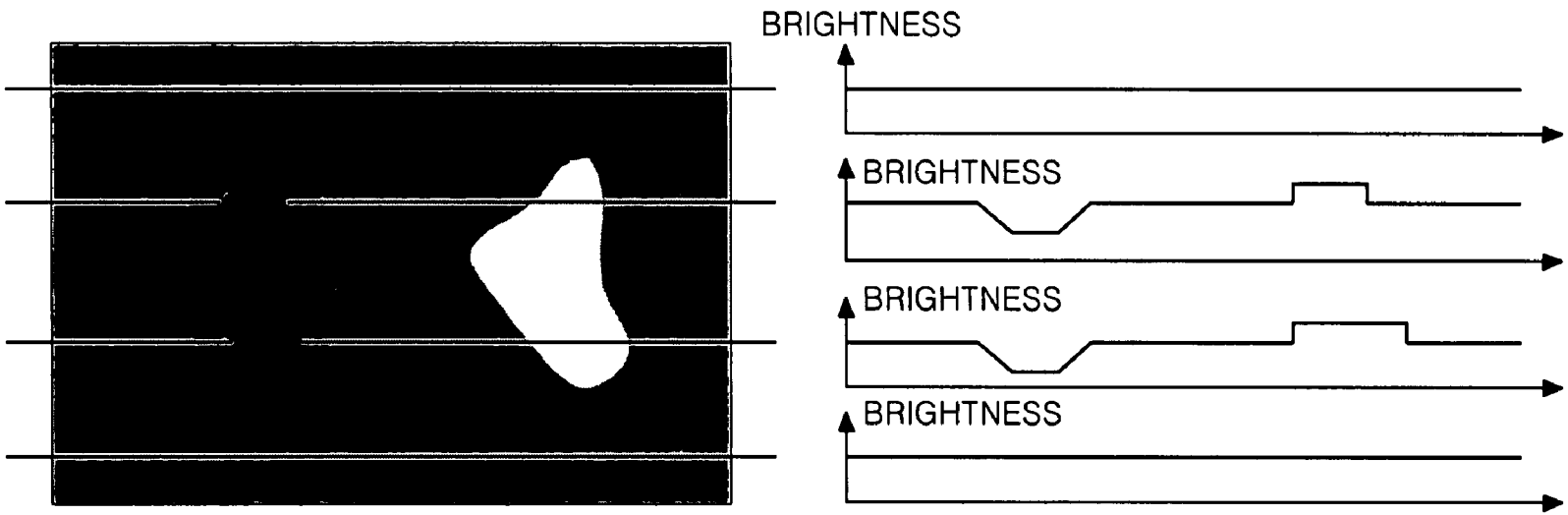
FIG. 1 RELATED ART
FIG. 1 illustrates a mura of undetermined form.
Figure 2:
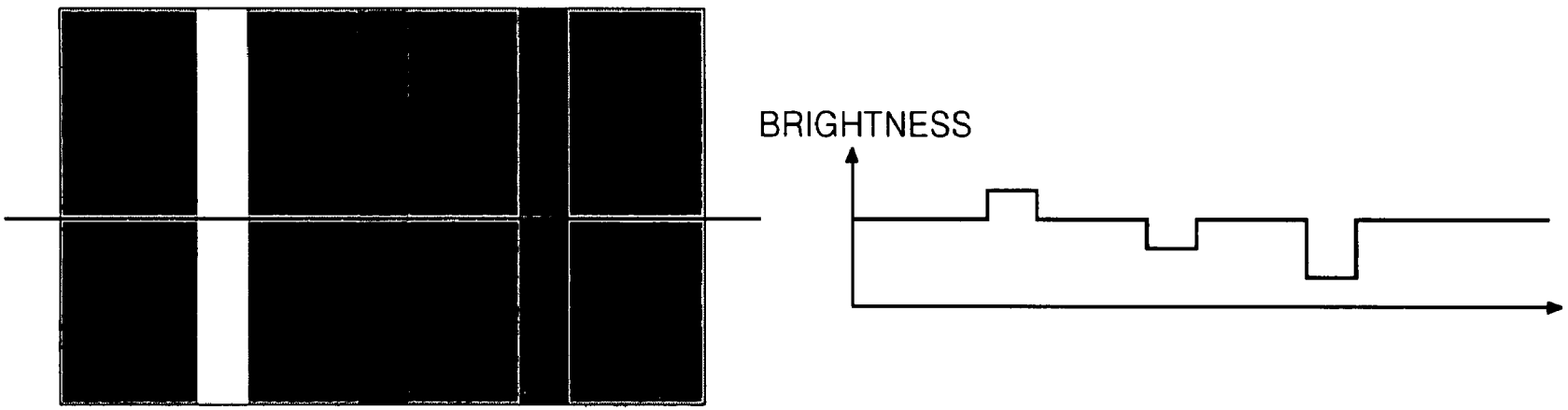
FIG.2 RELATED ART
FIG. 2 illustrates a mura of vertical belt shape.
Figure 3:
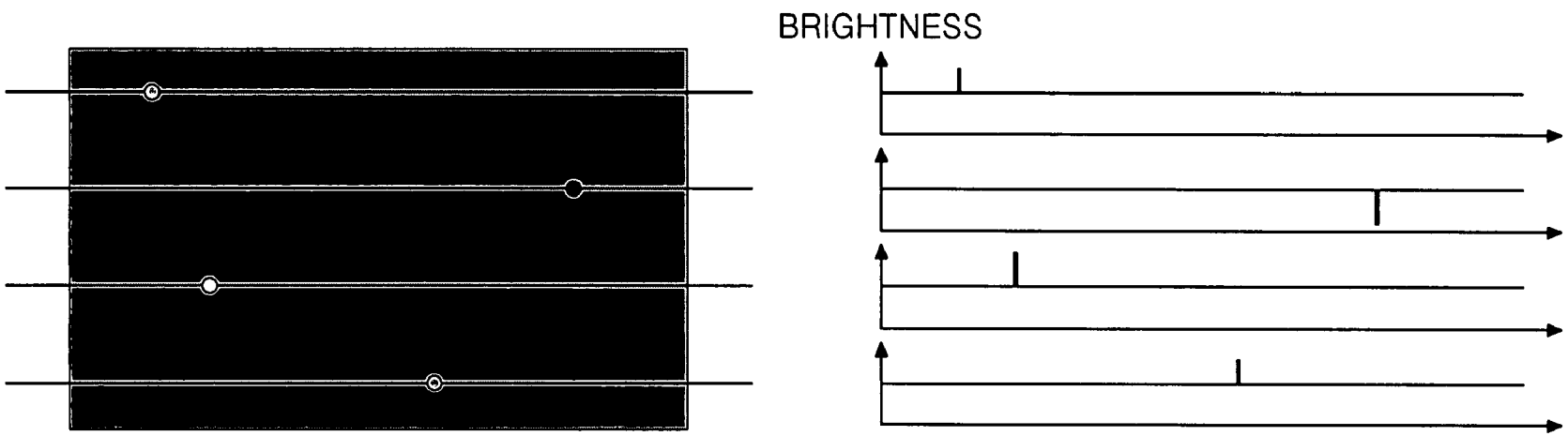
FIG. 3 RELATED ART
FIG. 3 illustrates a mura of dot shape.
Figure 4:
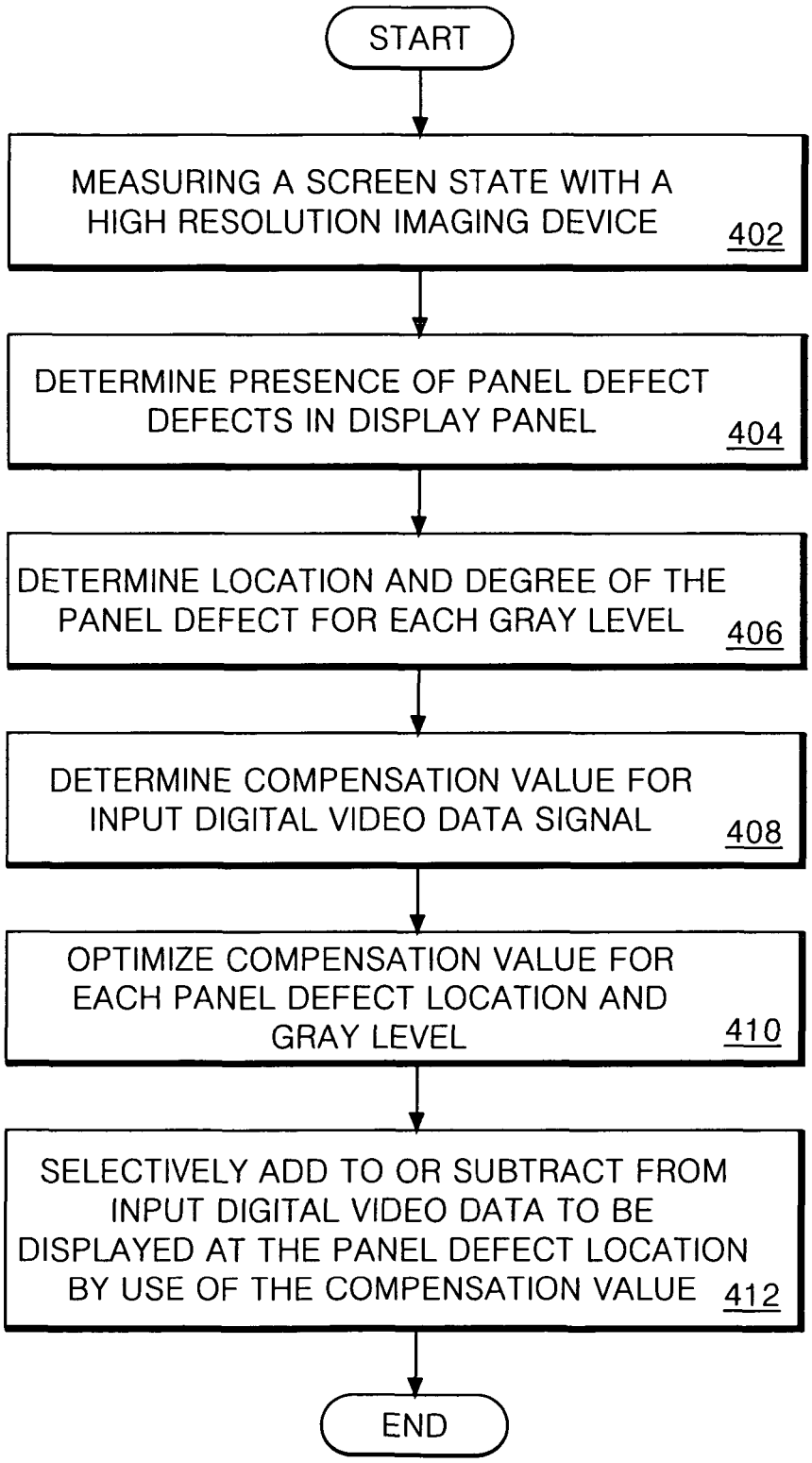
FIG. 4 illustrates acts that compensate for a mura.

FIG. 4 illustrates acts to control a picture quality of a flat panel display device.

Referring to FIG. 4, the picture quality control method on the panel defect measures a screen state after applying an input signal to a sample flat panel display device by use of measuring equipment such as a CCD camera or particle defect monitoring system for compensating a panel defect, such as a point, line, belt, or defect of undetermined form or a mura (Act 402). The picture quality control method of the flat panel display device measures the display picture of the sample flat panel display device with the measuring equipment such as a camera having higher resolution than the sample flat panel display device. An operator may review the panel scan results to determine the presence or absence of panel defects. The presence of a panel defect may be indicated by a region of the panel containing defects with a different brightness compared to other regions of the panel, such as brighter or dimmer pixel regions. In addition, the panel defect may contain pixels with different gray levels compared to other regions of the panel. The process may also be implemented by a suitably programmed computer that performs acts to analyze and determine the presence of absence of panel defects. The method increases the input signal of the flat panel display device by one gray level from the lowest gray level (black) to the highest gray level (white). For example, the picture quality control method of the flat panel display device receives an input signal of 8 bits for each of RGB and measures total 256 screens from 0 to 255 gray level in case of the flat panel display device having a resolution of 1366×768. Other numbers of gray levels may be possible as well. Each of the screens measured should have the resolution of 1366×768 or more and the brightness should have the resolution of at least 8 bits or more.

By analyzing the measured result, the picture quality control method on the panel defect judges the presence or absence of generation of the panel defect, at Act 404 and then if there is the panel defect in the sample flat panel display device, the picture quality control method of the flat panel display device sets a compensation value for compensating the brightness or color difference of the panel defect (Act 408). An input video data is modulated with the compensation value to compensate the brightness or color difference of the panel defect location. In Act 408, the picture quality control method of the flat panel display device determines the location and degree of the panel defect for each gray level from the result measured in the Act 404 (Act 406), and then determines the compensation value (Act 408).

Figure 5:
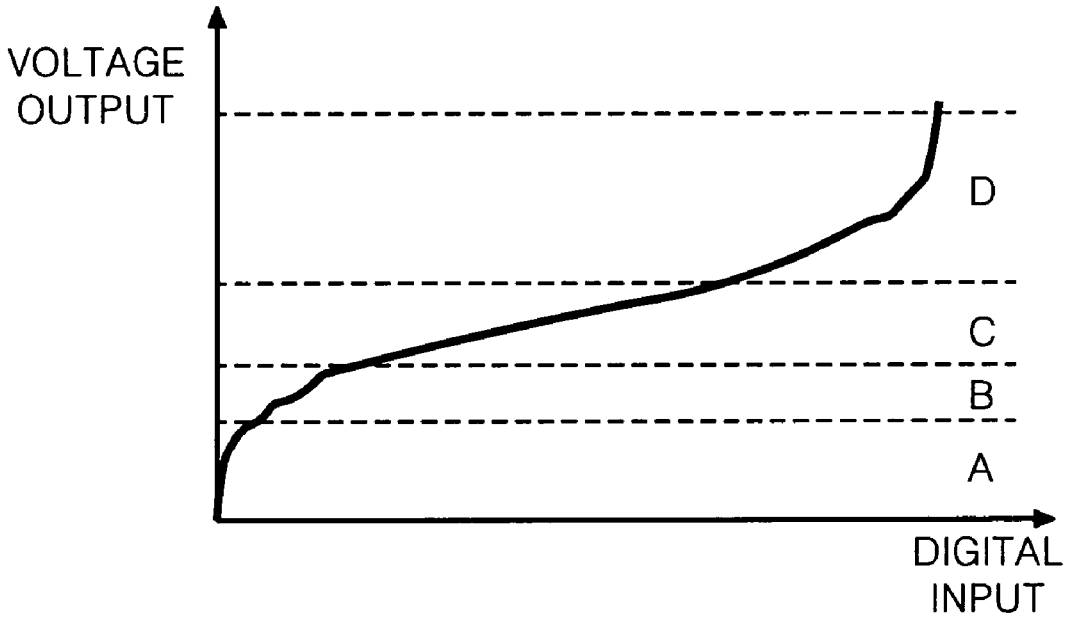
FIG. 5 illustrates a gamma characteristic.

The compensation value should be optimized for each location (Act 410) because the degree of unevenness of the brightness may be different in accordance with the location of the panel defect, and also should be optimized for each gray level in consideration of a gamma characteristic as illustrated in FIG. 5. The compensation value may be set for each gray level, or may be set for each gray level section (A, B, C, D) which includes a plurality of gray levels in FIG. 5. For example, the compensation value is set to be an optimized value for each location, i.e., '+1' in the location of 'panel defect 1', '−1' in the location of 'panel defect 2', '0' in the location of 'panel defect 3', etc. Further, it can be set as the optimized value for each gray level section, i.e., '0' in 'gray level section A', '0' in 'gray level section B', '1' in 'gray level section C', '1' in 'gray level section D', etc. The compensation value may be determined by calculating the difference between one or more pixels in the panel defect, and incrementally increasing or decreasing the brightness value of the defect panel pixels. Accordingly, the compensation value maybe made different in the same panel defect location for each gray level, and can also be different in the same gray level for each panel defect location. The compensation value may be set to be the same value in each of R/G/B data of one pixel. The compensation value may be set for each pixel inclusive of R/G/B sub-pixels. The compensation value set in this way is converted into 'Y' representing the brightness information of the pixel inclusive of R/G/B sub pixels and the compensation value for 'Y' representing the brightness information in U/V which represents color difference information. The compensation value set in this way (the compensation value for 'Y') is made into a look-up table along with the panel defect location data so as to be stored at a non-volatile memory.

The picture quality control method on the panel defect selectively adds to or subtracts from an input digital video data which is to be displayed at the panel defect location by use of the compensation value set in the Act 408, thereby modulating the corresponding digital video data (Act 412). Act 412 converts the input R/G/B digital video data into Y/U/V digital video data and expands the number of bits of Y data among the Y/U/V digital video data. The location where the Y/V/V digital video data are to be displayed and the gray level thereof are judged, so if the Y/U/V input digital video data are judged as the data to be displayed in the panel defect location, a pre-set compensation value is added to or subtracted from the 'Y' data. Y/U/V digital video data where the Y data are increased or decreased by the compensation value are converted into R/G/B digital video data to display in the screen of the display device, thereby compensating the panel defect.

Figure 6:
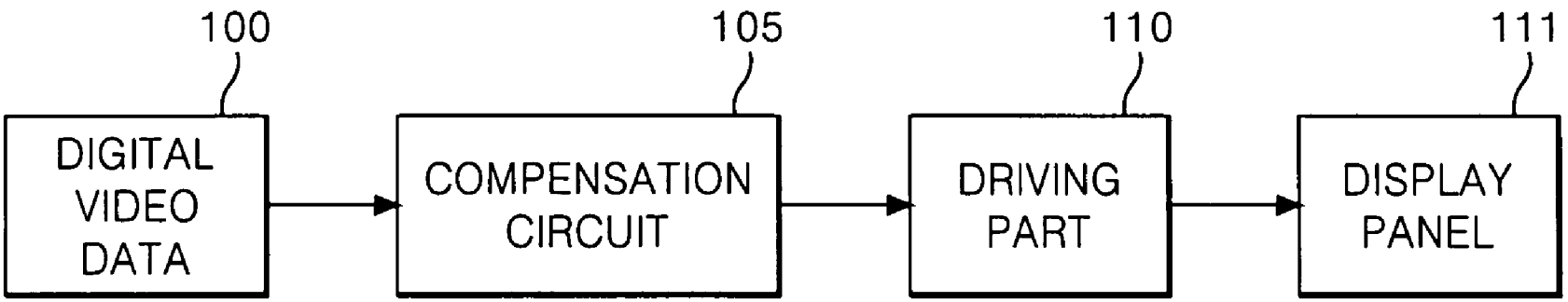
FIG. 6 illustrates a flat display device.

For the input signal compensation at Act 412, the flat panel display device, as shown in FIG. 6, includes a compensation circuit 105 which receives the digital video data 100, modulates the video data, and then supplies the video data to a driving part 110 which drives the display panel 111.

Figure 7:
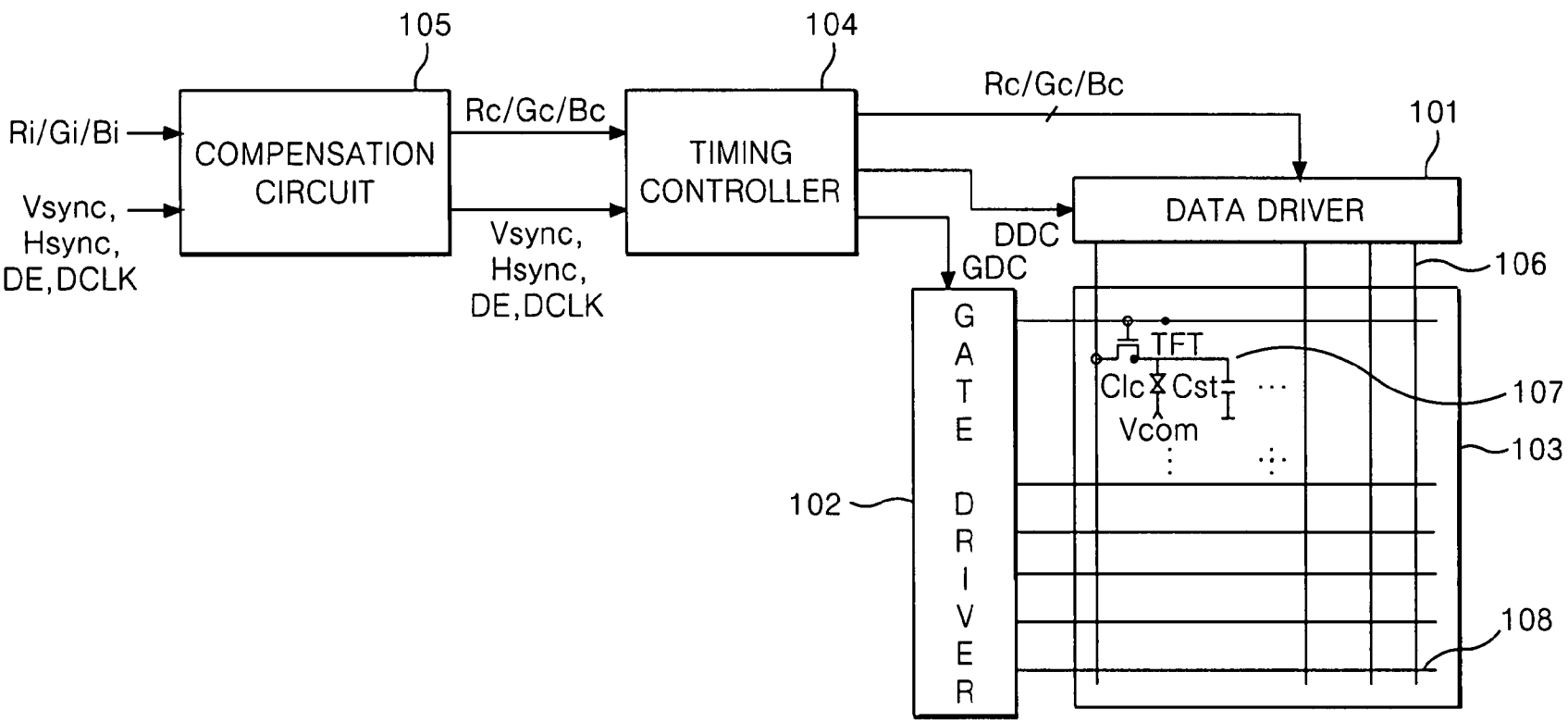
FIG. 7 is illustrates a liquid crystal display device

FIG. 7 illustrates a liquid crystal display device. Referring to FIG. 7, the liquid crystal display device includes a liquid crystal display panel 103. Data lines 106 cross gate lines 108 and a TFT 107 for driving a liquid crystal cell Clc is formed at each of the crossing part. A compensation circuit 105 generates a compensated digital video data Rc/Gc/Bc by use of an input digital video data Ri/Gi/Bi and a pre-set compensation value. A data driver 101, such as a data drive circuit 101 drives the data line 106 using of the compensated digital video data Rc/Gc/Bc. A gate driver 102, such as a gate driver circuit supplies a scan pulse to the gate lines 106. A timing controller 104 controls the data drive circuit 101 and the gate drive circuit 102.

The liquid crystal display panel 103 has liquid crystal molecules injected between two substrates, i.e., a TFT substrate and color filter substrate. The data lines 106 and the gate lines 108 formed on the TFT substrate cross each other, and are in communication with each other. The TFT formed at the crossing part of the data lines 106 and the gate lines 108 supplies an analog gamma compensation voltage supplied through the data line 106 to a pixel electrode of the liquid crystal cell Clc in response to a scan signal from the gate line 108. The black matrix, the color filter and the common electrode (not shown) are formed on the color filter substrate. One pixel on the liquid crystal display panel 103 includes R sub-pixel, G sub-pixel and B sub-pixel. A common electrode formed in the color filter substrate may be formed in the TFT substrate based on an electric field application method. A polarizer having a vertical polarizing axis is adhered to each of the TFT substrate and the color filter substrate.

The compensation circuit 105 receives the input digital video data Ri/Gi/Bi from a system interface (not shown) to modulate the input digital video data Ri/Gi/Bi to be supplied to the panel defect location by use of the pre-set compensation value, thereby generating the compensated digital video data Rc/Gc/Bc.

The timing controller 104 generates agate control signal GDC that controls the gate drive circuit 102 and a data control signal DDC that controls the data drive circuit 101 by use of a vertical/horizontal synchronization signal Vsync, Hsync, a data enable signal DE and a dot clock DCLK supplied through the compensation circuit 105, and supplies the compensated digital video data Rc/Gc/Bc to the data drive circuit 101 in accordance with dot clocks DCLK.

The data drive circuit 101 receives the compensated digital video data Rc/Gc/Bc, converts the digital video data Rc/Gc/Bc into the analog gamma compensation voltage, and supplies them to the data lines 106 of the liquid crystal display panel 103 under control of the timing controller 104.

The gate drive circuit 102 supplies a scan signal to the gate lines 108, thereby turning on the TFT's connected to the gate lines 108 to select the liquid crystal cells Clc of one horizontal line to which the analog gamma compensation voltage is to be supplied. The analog gamma compensation voltage generated from the data drive circuit 101 is synchronized with the scan pulse to be supplied to the liquid crystal cells Clc of the selected one horizontal line.

In reference to FIGS. 8 and 9, a detail description on the compensation circuit 105 will be made.

Figure 8:
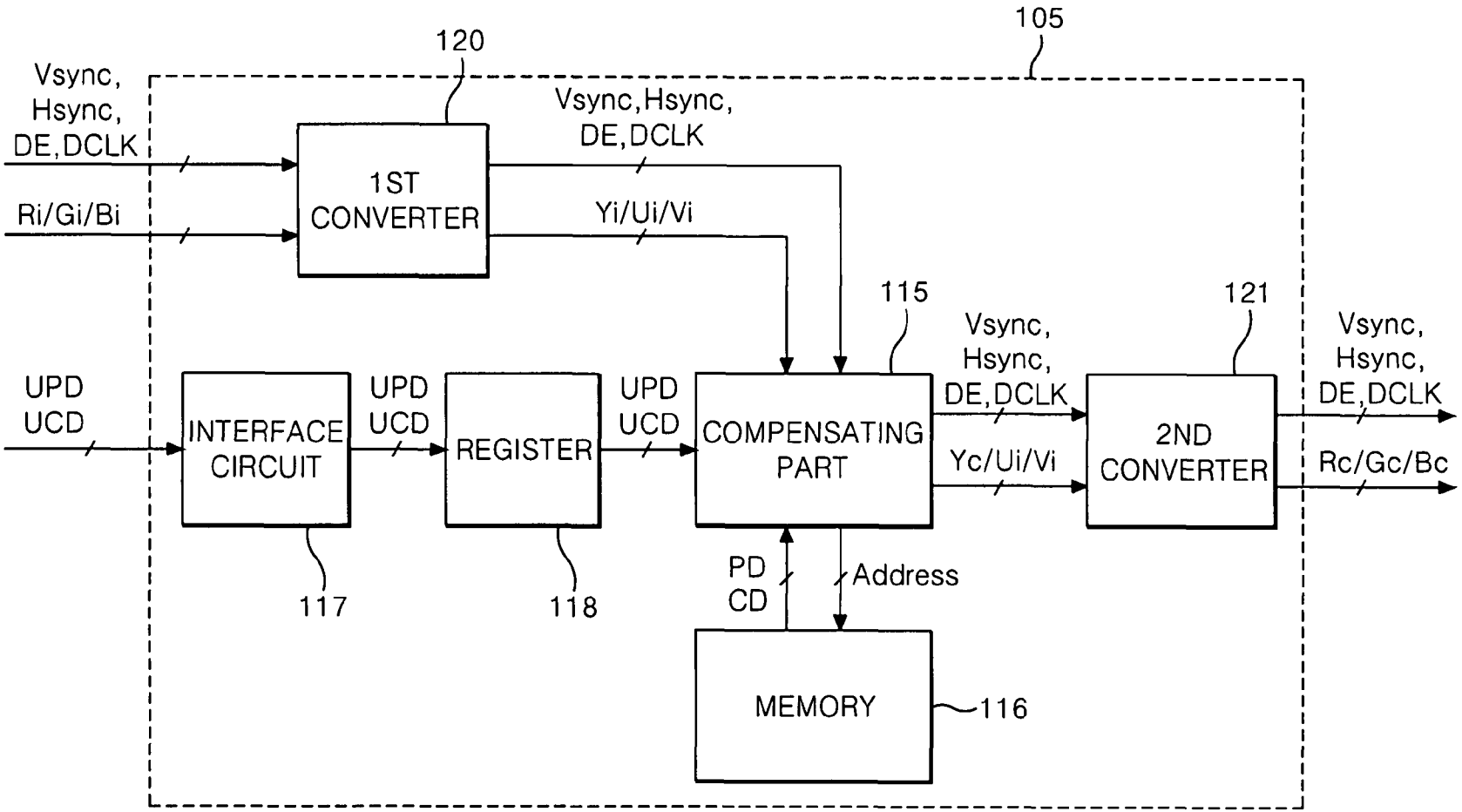
FIG. 8 illustrates a compensation circuit

Referring to FIG. 8, the compensation circuit 105 includes a memory 116 at which a location information and a compensation value for a panel defect location on the liquid crystal display panel 103 are stored. A first converter 120, such as an RGB to YUV converter converts the received input R/G/B digital video data Ri/Gi/Bi into the input Y/U/V digital video data Yi/Ui/Vi. A compensating part 115 modulates the input Y/U/V digital video data by use of the location information of the panel defect and the compensation value of the panel defect location from the memory 116 to generate the compensated Y/U/V input digital video data Yi/Ui/Vi. A second converter 121, such as a YUV to RGB converter converts the compensated Y/U/V input digital video data Yi/Ui/Vi into the R/G/B digital video data to generate the compensated R/G/B digital video data Rc/Gc/Bc. An interface circuit 117 communicates between the compensation circuit 105 and an external system (not shown). A register 118 temporarily stores the data to be stored at the memory 118 through the interface circuit 117.

The gray level of the input Y/U/V digital video data Yi/Ui/Vi, i.e., the data for the compensation value corresponding to the Y data, may be processed for each location of the panel defect along with the location of the panel defect. The compensation value corresponding to the Y data means a compensation value set in correspondence to each gray level which the Y data represents, or a compensation value set in correspondence to a gray level section which includes two or more gray levels. In case of setting the compensation value in correspondence to the gray level section, information for the gray level section, i.e., information of the gray level included in the gray level section, is also stored at the memory 116. The memory 116 might include a non-volatile memory such as EEPROM (electrically erasable programmable read only memory) with which the data for the compensation value and panel defect location can be renewed by the electrical signal from the external system.

It may be possible to transmit the panel defect compensation related data to EDI ROM (extended display identification data ROM) instead of EEFROM, and the EDI ROM can store the panel defect compensation related data at a separate storage space. The EDI ROM stores seller/buyer identification information and the variables and characteristics of a basic display device other than the panel defect compensation related data. When storing the panel defect compensation data at the EDI ROM instead of the EEPROM, a ROM recorder (not shown) transfers the panel defect compensation data through a DDC (data display channel). Hereinafter, the memory at which the panel defect compensation data are stored will be explained assuming that it is an EEPROM.

The interface circuit 117 provides a communication between the compensation circuit 105 and the external system, and the interface circuit 117 is designed according to the communication standard protocol such as I2C or other bus system communication standards. Examples of the signals UCD and UPD include data signals, clock signals, or other input signals. The external system can read the data stored at the memory 116 through the interface circuit 117 or may modify the data. The data for the compensation value CD and the pixel location PD stored at the memory 116 are required to be renewed because of a change in process, or a difference between application model. A user supplies the data for the compensation value UCD and the pixel location UPD, which are desired to be renewed., from the external system so that the data stored at the memory 116 can be modified.

To renew the pixel location PD and the compensation value CD stored at the memory 116, the register 118 temporarily stores the pixel location UPD and compensation value UCD data transmitted through the interface circuit 117.

The first converter 120 converts the input R/G/B digital video data Ri/Gi/Bi having the R/G/B data of 8/8/8 bits into the input Y/U/V digital video data Yi/Ui/Vi having the Y/U/V data of 10/10/10 bits through a coding process by use of the following mathematical formulas 1 to 3 below. Herein, the Y data among the Y/U/V data are data inclusive of the brightness information, and the U/V data are data inclusive of the color difference information.

$$Y=0.299Ri+0.587Gi+0.114Bi \quad \text{[Mathematical Formula 1]}$$

$$U=-0.147Ri-0.289Gi+0.436Bi=0.492(Bi-Y) \quad \text{[Mathematical Formula 2]}$$

$$V=0.615Ri-0.515Gi-0.100Bi=0.877(Ri-Y) \quad \text{[Mathematical Formula 3]}$$

The compensating part 115 receives the input Y/U/V digital video data Yi/Ui/Vi from the first converter 120 and if the input Y/U/V digital video data Yi/Ui/Vi is the data to be displayed in the panel defect location, the Y data among the input Y/U/V digital video data Yi/Ui/Vi are increased or decreased by the pre-set compensation value to generate the compensated Y/U/V digital video data Yc/Ui/Vi.

Figure 9:
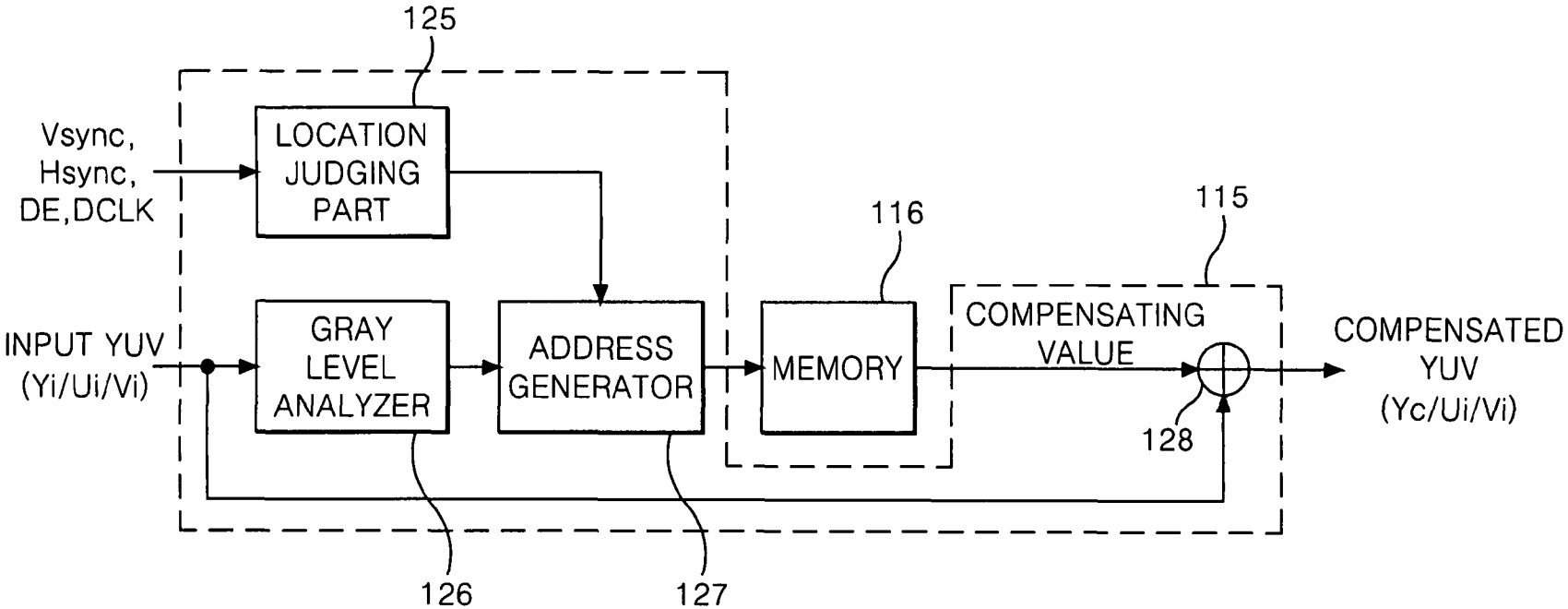
FIG. 9 illustrates a compensating part.

The compensating part 115, as shown in FIG. 9, includes a location judging part 125 for judging the location of the input Y/U/V digital video data Yi/Ui/Vi. A gray level analyzer 126 analyzes the gray level area of the input Y/U/V digital video data Yi/Ui/Vi by analyzing the Y component of the Yi/Ui/Vi input. An address generating part, such as an address generator 127 generates a read address to read the compensation value from the memory 116 using the location and gray level information of the input Y/U/V digital video data Yi/Ui/Vi supplied from the location judging part 125 and the gray level analyzer 126. An operating part 128 adjusts, such as by increasing or decreasing, the Y data Yi of the input Y/U/V digital video data Yi/Ui/Vi by the compensation value which is loaded from the memory 116.

The location judging part 125 judges a location where the input Y/U/V digital video data Yi/Ui/Vi are to be displayed on the liquid crystal display panel 103, using any one or more of vertical/horizontal synchronization signal Vsync, Hsync, dot clock DCLK and data enable signal DE. It may be possible to judge the location where the input Y/U/V digital video data Yi/Ui/Vi are to be displayed on the liquid crystal display panel 103, by counting the horizontal synchronization signal Hsync and the dot clock DCLK.

The gray level analyzer 126 analyzes the gray level area of the input digital video data Ri/Gi/Bi. The gray level of the input digital video data Ri/Gi/Bi or the gray level section inclusive of the gray level is analyzed.

The address generating part 127 receives the location information of the input digital video data Ri/Gi/Bi from the location judging part 125 and the gray level information of the input digital video data Ri/Gi/Bi from the gray level analyzer 126, and generates a read address for accessing the address of the memory 116 at which the compensation value corresponding to the location and gray level of the input digital video data Ri/Gi/Bi.

The operating part 128 generates the compensated Y/U/V digital video data Yc/Ui/Vi by adjusting, such as increasing or decreasing, the Y data Yi of the input Y/U/V digital video data Yi/Ui/Vi by the compensation value loaded from the address of the memory 116 corresponding to the read address which is generated by the address generating part 127.

The second converter 121 converts the compensated Y/U/V digital video data Yc/UiVi having the Y/U/V data of 10/10/10 bits into the compensated R/G/B digital video data Rc/Gc/Bc having the R/G/B data of 8/8/8 bits through the coding process by use of the following mathematical formulas 4 to 5.

$$R=Yc+1.140Vi \quad \text{[Mathematical Formula 4]}$$

$$G=Yc-0.395Ui-0.581Vi \quad \text{[Mathematical Formula 5]}$$

$$B=Yc+2.032Ui \quad \text{[Mathematical Formula 6]}$$

The liquid crystal display device converts the R/G/B data to be displayed in the panel defect location into the Y/U/V video data where the brightness component and the color component are separated, by compensating for the fact that the human eye is more sensitive to a brightness difference than to a color difference. The number of bits of the Y data inclusive of the brightness information among them is expanded to control the brightness of the panel defect location. There may be an advantage in that it is possible to make a minute adjustment for the panel defect location.

The compensation circuit like the above can be integrated into one chip along with the timing controller 104, and the case of applying the compensation circuit 105 to the liquid crystal display device is given as an example, but the compensation circuit 105 can be applied to the other flat panel display devices other than the liquid crystal display device.

As described above, the flat panel display device and the picture quality control method compensates the panel defect by use of the circuit. There may be an advantage in that it may be possible to more properly deal with various shapes of panel defect following panel production than the panel defect compensation in the process. Further, the flat panel display device and the picture quality control method converts the R/G/B data to be displayed in the panel defect location into the Y/U/V video data where the brightness component and the color component are separated, and controls the brightness of the panel defect location by adjusting, such as by expanding the number of bits of the Y data inclusive of the brightness information. It maybe possible to realize natural and high-grade picture quality because the minute adjustment of the brightness for the panel defect location is possible.

Although the disclosure has been explained by the examples shown in the drawings described above, it should be understood to the ordinary skilled person in the art that the disclosure is not limited to the embodiments, but rather that various changes or modifications thereof are possible. Accordingly, the scope of the disclosure shall be determined only by the appended claims and their equivalents.

What is claimed is:

1. A flat panel display device, comprising:

a display panel;

a memory operable to store a location information and a compensation value for a panel defect location on the display panel;

a first converter operable to calculate a brightness signal and a color difference signal from an inputted video signal to be displayed in the display panel and operable to expand a number of data bits of the brightness signal to generate an expanded brightness signal;

a compensating part operable to generate a compensated brightness signal by compensating the expanded brightness signal of the video signal, to be displayed in the panel defect location, by the compensation value in reference to the memory;

a second converter operable to calculate a compensated video signal from the color difference signal and the compensated brightness signal, wherein the compensated video signal has the same number of bits as the inputted video signal; and a drive circuit operable to drive the display panel by use of the compensated video signal and an uncompensated video signal.

2. The flat panel display device according to claim 1, wherein the compensating part is further operable to adjust the expanded brightness signal by increasing the expanded brightness signal.

3. The flat panel display device according to claim 1, wherein the compensating part is further operable to adjust the expanded brightness signal by decreasing the expanded brightness signal.

4. The flat panel display device according to claim 1, wherein the compensation value is set differently based on the panel defect location and for the gray level of the data that is to be displayed in the panel defect location.

5. The flat panel display device according to claim 1, wherein the compensation value comprises a value for compensating the brightness signal.

6. The flat panel display device according to claim 1, wherein the memory comprises a memory operable to renew data therein.

7. The flat panel display device according to claim 6, wherein the memory comprises at least one of an EEPROM or an EDID ROM.

8. The flat panel display device according to claim 1, wherein the display panel comprises:

a liquid crystal display panel where a plurality of data lines are in communication with a plurality of gate lines and a plurality of liquid crystal cell are disposed, and wherein the drive circuit comprises:

a data drive circuit operable to supply the compensation data to the data lines;

a gate drive circuit operable to supply a scan pulse signal to the gate lines; and a timing controller operable to control the drive circuits and operable to supply the compensation data to the data drive circuit.

9. The flat panel display device according to claim 8, wherein the compensating part is in communication with the timing controller.

10. The flat panel display according to claim 9, wherein the compensating part is located within the timing controller.

11. The flat panel display device of claim 1, wherein each of the inputted video signal and the compensated video signal comprise red, green, and blue signals.

12. A picture quality controlling method on panel defects, comprising:

measuring a brightness and a color difference in a panel defect location, where at least one of a brightness or a color difference is different from that of at least one of a brightness or a color difference of a different part in a display panel;

determining a compensation value related to the panel defect location;

calculating a brightness signal and color difference signals from component an inputted video signals to be displayed in the display panel;

generating an expanded brightness signal by adjusting a number of data bits of the brightness signal;

generating a compensated brightness signal by compensating the adjusted brightness signal of the video signal, to be displayed in the panel defect location, by the compensation value;

calculating a compensated video signal from the color difference signals and the compensated brightness signal, wherein the compensated video signal has the same number of bits as the inputted video signal; and driving the display panel using the compensated video signal.

13. The picture quality controlling method according to claim 12, further comprising determining differently the compensation value for the panel defect location and for the gray level of the data that is to be displayed in the panel defect location.

14. The picture quality controlling method according to claim 12, wherein the determining the compensation value comprises determining the compensation value to be a value for compensating the brightness signal.

15. The picture quality controlling method according to claim 12, wherein the adjusting the expanded brightness signal of the video signal comprises increasing the expanded brightness signal.

16. The picture quality controlling method according to claim 12, wherein the adjusting the expanded brightness signal of the video signal comprises decreasing the expanded brightness signal.

* * * * *